United States Patent [19]

Wicks

[11] 4,003,138

[45] Jan. 18, 1977

[54] AIR CURTAIN FOR CLOTHES DRYER

[76] Inventor: Wayne M. Wicks, 13th and Johnson Sts., Sturgis, Ky. 42459

[22] Filed: Sept. 23, 1975

[21] Appl. No.: 615,974

[52] U.S. Cl. ..... 34/86; 34/133; 34/235

[51] Int. Cl.[2] ..... F26B 19/00

[58] Field of Search ..... 34/86, 133, 139, 131, 34/235, 68; 110/49 R; 165/128, 139; 432/105, 107, 109

[56] References Cited

UNITED STATES PATENTS

| | | | |
|---|---|---|---|
| 1,014,573 | 1/1912 | Davis | 110/49 R |
| 2,818,719 | 1/1958 | Cline | 34/86 |
| 3,001,297 | 9/1961 | Plumer | 34/133 |
| 3,157,391 | 11/1964 | Angelone | 34/133 |
| 3,831,294 | 8/1974 | Freze | 34/133 |
| 3,861,865 | 1/1975 | Grantham | 432/105 |

*Primary Examiner*—Kenneth W. Sprague
*Assistant Examiner*—James C. Yeung
*Attorney, Agent, or Firm*—Clarence A. O'Brien; Harvey B. Jacobson

[57] ABSTRACT

An inflow of air to a commercial clothes dryer is preheated by passage through a heated air curtain established by discharge of heated air from a nozzle outlet of an expansion chamber housing. The housing is supplied with heated air from a vertical exhaust conduit through which the air dryer is vented.

9 Claims, 4 Drawing Figures

AIR CURTAIN FOR CLOTHES DRYER

This invention relates generally to drying apparatus and more particularly to commercial clothes drying apparatus through which a forced flow of air is conducted including both gas fired and electric dryers.

It is generally well known that dryer apparatus may be more efficiently operated by heat exchange between the heated exhaust air of the dryer and the fresh intake air to preheat the intake air. Such prior art arrangements are disclosed for example in U.S. Pat. Nos. 3,066,423, 3,157,391, 3,859,735, 3,861,864 and 3,861,865. Such prior art arrangements are, however, relatively complex and expensive and often require radical modification of the drying apparatus. It is therefore an important object of the present invention to provide a relatively simple and economical device for preheating the intake air to clothes dryer such as existing commercial dryers, without any radical modification thereof.

In accordance with the present invention, the intake air to a clothes dryer is preheated by establishing a curtain of heated air in front of or on the upstream side of the intake opening to the dryer. This curtain of heated air is established by discharge of heated air from a laterally elongated nozzle outlet of an expansion chamber box to which heated air is conducted from the exhaust conduit associated with the dryer apparatus. The central core of the heated outflow airstream within the exhaust conduit is received within an elbow section inserted into the exhaust conduit and connected by a flexible transfer conduit to the expansion box or housing from which the heated air curtain is discharged at a location just below the intake opening. The expansion box reduces the airflow velocity and through the outlet nozzle distributes the outflowing air in order to establish the air curtain. Accordingly, heat exchange occurs between the incoming air and the heated air curtain by direct contact.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
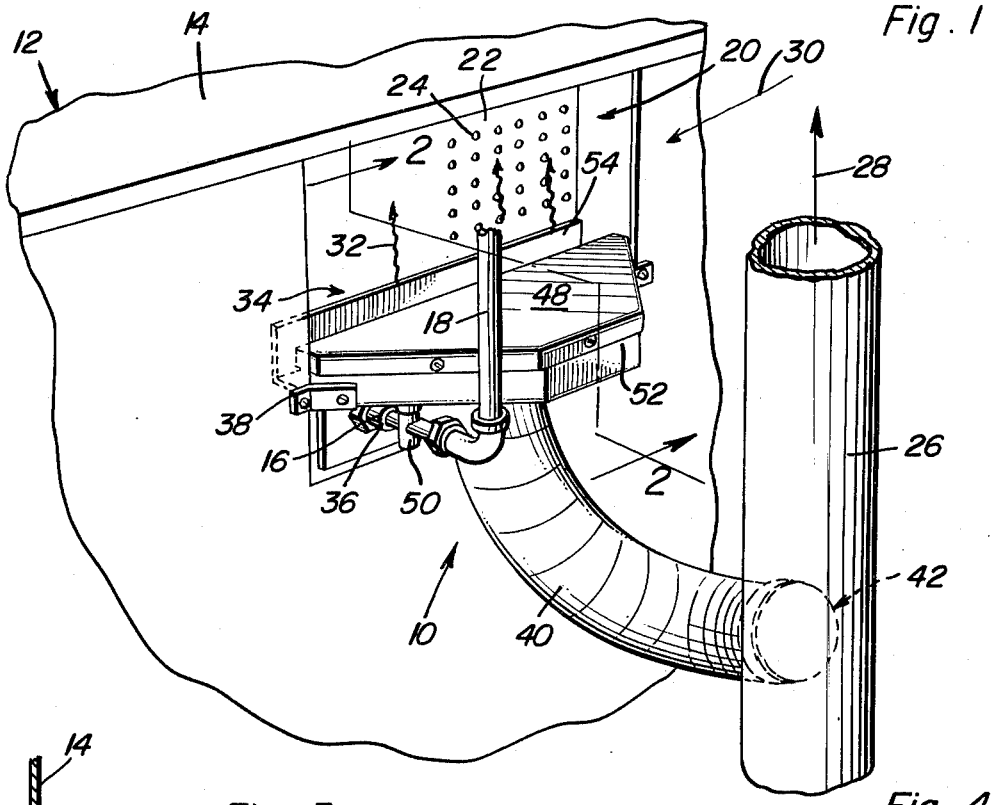
FIG. 1 is a perspective view showing a typical installation for the device of the present invention.

Referring now to the drawings in detail, FIG. 1 illustrates a typical installation for the preheating device of the present invention generally referred to by reference numeral 10. As shown, the preheating device is associated with a commercial type of clothes dryer generally referred to by reference numeral 12 which includes an enclosure 14, the rear side of which has a gas burner 16 connected to a supply of gas through the gas conduit 18. The gas burner 16 extends into the enclosure 14 just below an intake 20 opening to atmosphere by an intake screen 22 having a plurality of intake openings 24 therein as shown. Commercial clothes dryers of this type as well known so that no further details as to its construction and operation is described. The only other operational and structural features of the dryer that need be explained in connection with the present invention involves a vertical exhaust conduit 26 shown spaced rearwardly from the dryer enclosure 14 in FIG. 1. The vertical exhaust conduit 26, as is well known, vents the dryer enclosure 14 and conducts an upward flow stream of heated air as indicated by arrow 28. A forced flow of air is conducted through the dryer, the air acting as the heat transfer medium. Thus, an inflow of air is drawn into the dryer enclosure 14 through the intake 20 as indicated by arrows 30 in FIG. 1.

In accordance with the present invention, a curtain of unconfined heated air as indicated by arrows 32 in FIG. 1 is established externally of the enclosure 14 as shown on the upstream side of the intake 20 through which the incoming air 30 must pass. The air curtain 32 is established by upward discharge to atmosphere as shown from an elongated outlet nozzle generally referred to by reference numeral 34 which is associated with an expansion chamber housing generally referred to by reference numeral 36. The housing 36 is fixedly mounted externally on the dryer enclosure 14 by means of brackets 38. Heated air is supplied to the housing 36 by means of a flexible type of transfer conduit 40. A flow diverting elbow section generally referred to by reference numeral 42 as more clearly seen in FIG. 4, is positioned within the exhaust conduit 26 and connected to the transfer conduit 40 in order to receive a portion of the heated outflow of air which is thereby directed to the expansion housing 36.

Figure 4:
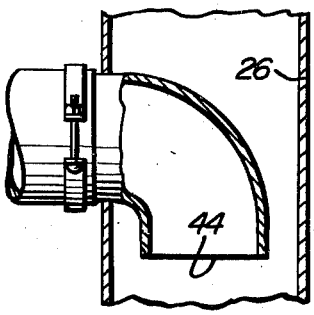
FIG. 4 is a partial sectional view taken substantially through a plane indicated by section line 4—4 in FIG. 3.

As more clearly seen in FIG. 4, the elbow section 42 has an inlet end 44 centrally positioned within the exhaust conduit 26 so that the inflow area is substantially perpendicular to the upward flow stream of heated air within the exhaust conduit and radially spaced from the walls of the exhaust conduit. Accordingly, only the central core portion of the flow stream will be received within the flow diverting elbow section 42, this central core having most of the heat content since it is spaced from the heat radiating walls of the exhaust conduit. Accordingly, the air supplied to the expansion housing 36 will be at a relatively high temperature.

Figure 3:
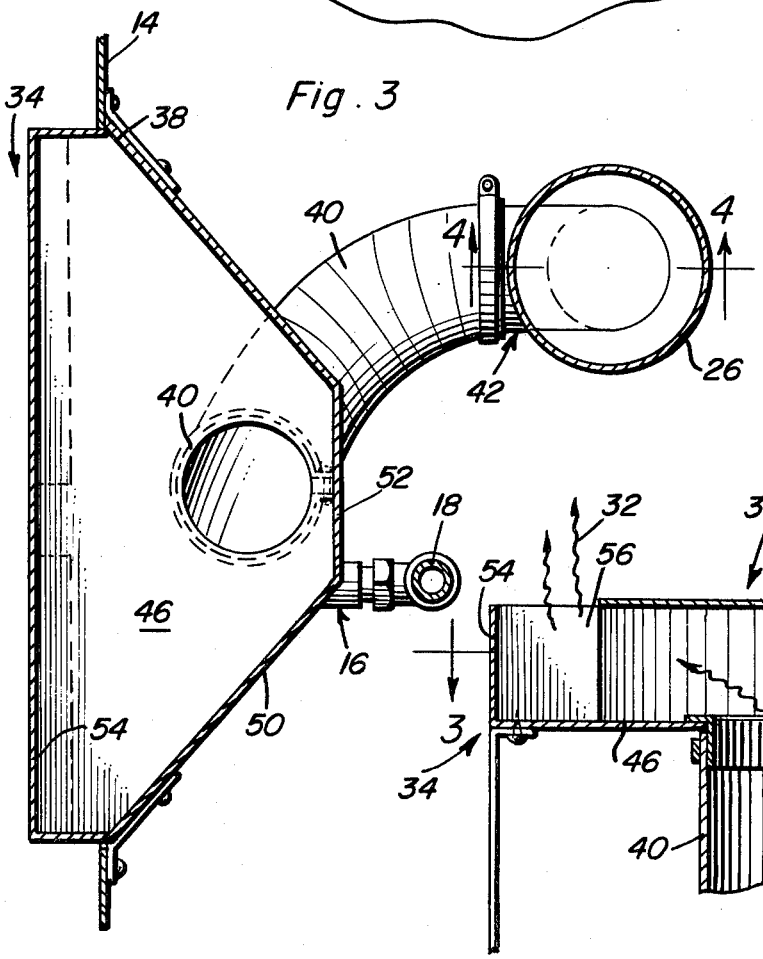
FIG. 3 is a top sectional view taken substantially through a plane indicated by section line 3—3 in FIG. 2.
Figure 2:
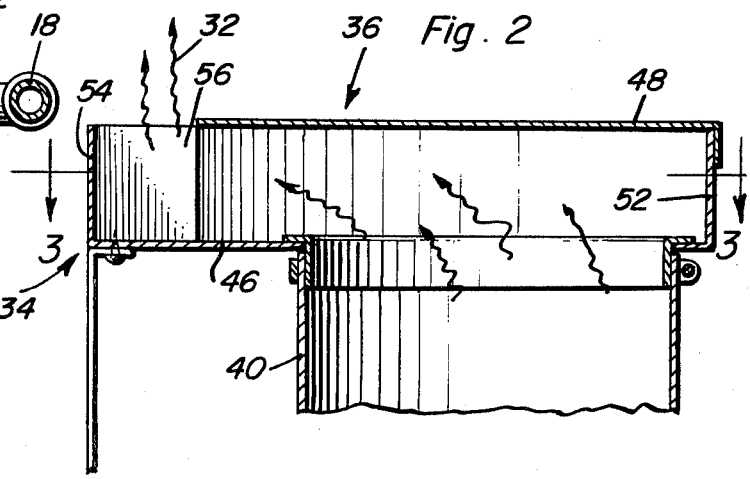
FIG. 2 is a partial sectional view taken substantially through a plane indicated by section line 2—2 in FIG. 1.

As more clearly seen in FIGS. 2 and 3, the outlet end of the transfer conduit 40 is connected to the bottom wall 46 of the expansion housing 36. The bottom wall as well as the top wall 48, are generally trapezoidal in shape and interconnected by a pair of side walls 50 that diverge from an end wall 52. The walls of the expansion housing 36 thereby form a diverging flow passage between the transfer conduit 40 and the outlet nozzle 34. The outlet nozzle is formed by a vertical deflector element 54 that is connected to the bottom wall 46 in spaced relationship to the upper wall 48 so as to form an upwardly discharging outlet opening 56 as more clearly seen in FIG. 2. It will therefore be apparent that the heated air will be reduced in flow velocity by volumetric expansion within the expansion housing 36 and will be discharged from the laterally elongated opening 56 of the outlet nozzle 34 in order to form the heated air curtain 32.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with an air heating dryer or the like having an enclosure within which a heating device is located for heating air entering the enclosure through an intake opening to atmosphere and wherein the enclosure is vented by an exhaust conduit through which an outflow stream of heated air is conducted, means for preheating air entering the enclosure, comprising flow diverting means connected to the exhaust conduit for receiving said heated air under a relatively high outflow velocity, and flow directing means connected to said flow diverting means for atmospherically discharging said heated air adjacent to said intake in a direction transversely of the inflow through the intake to establish an unconfined curtain of heated air externally of the enclosure through which the air entering the intake must pass.

2. The combination of claim 1 wherein said flow directing means includes a transfer conduit connected to the flow diverting means, a housing fixed externally to the enclosure below the intake enclosing an expansion chamber into which the heated air is discharged by the transfer conduit, elongated nozzle means connected to the housing for discharging the heated air therefrom in said transverse direction relative to the inflow of air entering the enclosure through the intake, and means connecting the transfer conduit to the housing in spaced relation to the nozzle means for reducing the outflow velocity of the heated air by volumetric expansion within the expansion chamber prior to being discharged through the nozzle means.

3. The combination of claim 2 wherein said flow diverting means includes a pick-up tube section positioned centrally within the exhaust conduit having an inlet flow area substantially perpendicular to said outflow stream within the exhaust conduit and an outlet connected to the transfer conduit externally of the exhaust conduit.

4. The combination of claim 1 wherein said flow diverting means includes a pick-up tube section positioned centrally within the exhaust conduit having an inlet flow area substantially perpendicular to said outflow stream within the exhaust conduit and an outlet connected to the flow diverting means externally of the exhaust conduit.

5. In combination with a heating apparatus having an enclosure through which a forced flow of air is conducted between an intake opening to atmosphere and an exhaust conduit, means for preheating the air entering the enclosure through the intake by heat exchange with the air being vented through the exhaust conduit, comprising flow diverting means connected to the exhaust conduit for receiving a central core of a heated outflow air stream therein, a transfer conduit connected to the flow diverting means, expansion chamber means connected to the transfer conduit for reducing the velocity of the heated air conducted thereto by the transfer conduit from the flow diverting means, and nozzle means connected to the expansion chamber means for atmospherically discharging the heated air within an unconfined air curtain pattern in close adjacency to the intake externally of the enclosure, whereby said air entering the enclosure must pass through said heated air being discharged by the nozzle means.

6. The combination of claim 5 wherein said expansion chamber means comprises a housing enclosing a diverging passage between the transfer conduit and the nozzle means and means fixedly mounting the housing externally on the enclosure below the intake opening, said housing having interconnected upper, lower and end walls, and a pair of side walls extending in diverging relation from the end wall between the upper and lower walls, said transfer conduit being connected to the bottom wall adjacent to the end wall.

7. The combination of claim 6 wherein said nozzle means comprises a flow deflecting element connected to the bottom wall in spaced relation to the upper wall to form an upwardly discharging outlet for the diverging passage.

8. The combination of claim 7 wherein said flow diverting means includes a pick-up tube section positioned centrally within the exhaust conduit having an inlet flow area substantially perpendicular to said outflow stream within the exhaust conduit and an outlet connected to the transfer conduit externally of the exhaust conduit.

9. The combination of claim 5 wherein said flow diverting means includes a pick-up tube section positioned centrally within the exhaust conduit having an inlet flow area substantially perpendicular to said outflow steam within the exhaust conduit and an outlet connected to the transfer conduit externally of the exhaust conduit.

* * * * *